US007719212B2

(12) United States Patent
Matsumoto

(10) Patent No.: US 7,719,212 B2
(45) Date of Patent: May 18, 2010

(54) DISPLAY DEVICE HAVING A VARIABLE AC SOURCE

(75) Inventor: Teruhiko Matsumoto, Ebina (JP)

(73) Assignee: Hitachi, Ltd., Tokyo (JP)

( * ) Notice: Subject to any disclaimer, the term of this patent is extended or adjusted under 35 U.S.C. 154(b) by 142 days.

(21) Appl. No.: 11/654,052

(22) Filed: Jan. 16, 2007

(65) Prior Publication Data

US 2007/0205726 A1 Sep. 6, 2007

(30) Foreign Application Priority Data

Jan. 16, 2006 (JP) ..... 2006-006911

(51) Int. Cl.
*G05F 1/00* (2006.01)

(52) U.S. Cl. ..... 315/309; 315/307; 315/291; 315/274; 315/224

(58) Field of Classification Search ..... 315/309, 315/307, 308, 297, 291, 224, 209 R, 274
See application file for complete search history.

(56) References Cited

U.S. PATENT DOCUMENTS 5,705,897 A * 1/1998 Hanazaki et al. ..... 315/307
2006/0012309 A1* 1/2006 Monch et al. ..... 315/112

FOREIGN PATENT DOCUMENTS

JP 2005-025981 A 1/2005

* cited by examiner

*Primary Examiner*—Tuyet Vo
(74) *Attorney, Agent, or Firm*—Townsend and Townsend and Crew LLP

(57) ABSTRACT

When there is a temperature difference along the length of a cold cathode tube used as a light source for a display device, a cataphoresis phenomenon occurs due to movement of mercury enclosed contained within the tube, thereby shortening the tube life. In order to solve this problem, temperature sensors are provided to detect a temperature difference between both the ends of the tube. A duty cycle of a voltage waveform to be applied from a DC/AC inverter to the tube is changed so as to cancel movement of the mercury due to the temperature difference.

4 Claims, 12 Drawing Sheets

DISPLAY DEVICE HAVING A VARIABLE AC SOURCE

INCORPORATION BY REFERENCE

The present application claims priority from Japanese application JP2006-006911 filed on Jan. 16, 2006, the content of which is hereby incorporated by reference into this application.

BACKGROUND OF THE INVENTION

The present invention relates to power source apparatus that AC drive a cold cathode tube, and more particularly to a field of techniques for adjusting an alternate current drive waveform to be applied to a cold cathode tube for use in a display device.

In recent electronic apparatus, liquid crystal display devices excellent in miniaturization and space saving as display devices from which users acquire information are greatly used instead of the conventional Brown tubes.

FIG. 2 shows an example of one of the conventional liquid crystal display devices with a backlight that are used generally in information processing apparatus. The backlight 5 is a light source. A liquid crystal panel 6 adjusts the transitivity of each of the display pixels of the display device using a liquid crystal control circuit 7 and hence a quantity of light coming from the backlight 7, thereby displaying a picture. Some of the liquid crystal display devices put to practical use at present can differ in backlight position and/or drive system in which the display pixels of the liquid crystal panel are driven. With transmissive liquid crystal display devices, a similar structure is employed in which a picture is displayed using light emitted by the backlight.

Although EL elements and LEDs are used as the backlights, cold cathode tubes are generally diffused. Since the cold cathode tubes have high luminosity efficiency and can be produced at low cost, they are very excellent as light sources for transmissive liquid crystal display devices. FIG. 3 shows the internal structure of the cold cathode tube, which encloses mercury 10 and an inert gas such as neon or argon with the internal surface of the tube coated with a fluorescent paint. When an alternate current voltage of several hundred volts is applied across a pair of electrodes 8 each provided at a respective one of both ends of the tube, the mercury enclosed within the tube is excited, thereby emitting UV rays. When the UV rays are applied to the fluorescent paint 9 coated on the inner surface of the tube, the fluorescent paint becomes luminescent, thereby performing a role as a light source.

When this cathode tube is driven repeatedly, the internal mercury changes to amalgam or ineffective mercury, which is any longer excited and cannot contribute to luminescence. Thus, the life of the cathode tube is determined depending on the quantity of mercury enclosed within the tube, but the enclosed quantity of mercury is limited by the size of the tube. Further, the life of the cathode tube is influenced by a quantity of current driven into the tube and the environmental temperature of the tube. Thus, how to prolong the life of the tube has been hitherto studied.

The life modes of the cathode include the simple consumption of mercury as well as an uneven longitudinal distribution of mercury within the tube. FIG. 4 schematically illustrates a life mode in this case. Usually, mercury is uniformly distributed longitudinally within the tube such that the whole tube gets luminescent. When the tube is placed in a state called cataphoresis in which the mercury within the tube moves to one end side of the tube for some reason, the other end side of the tube where no mercury is present cannot become luminescent although the whole quantity of mercury within the tube is not consumed. Thus, the one end side of the display becomes extremely dark, as viewed from a user, and the display device cannot be used, which also is a kind of life mode.

For example, JPA-2005-025981 discloses a technique that proposes a technique for preventing uneven longitudinal luminosity in the cold cathode tube.

SUMMARY OF THE INVENTION

Main causes for the cataphoresis phenomenon will be described next. FIG. 5 shows movement of mercury ions 11 within the cold cathode tube. Reference numeral 8 shows a pair of electrodes of the tube across which an AC volt is applied. FIG. 6 shows a waveform of the AC voltage applied across the pair of electrodes 8.

As shown in FIG. 6, since the voltage applied across the pair of electrodes 8 is of an AC, the potential changes alternately between plus and minus with reference to a time axis. When the potential applied across the pair of electrodes 8 is plus, mercury ions 11 have positive charges, and move leftward in FIG. 5. Conversely, when a minus potential is applied across the pair of electrodes 8, the mercury ions 11 move rightward. The moving quantities of mercury ions are directly proportional to respective time periods when the plus and minus potential of the AC waveform are applied across the pair of electrodes 8. As shown in FIG. 6, usually, the ratio in time span of the plus side to the minus side of the AC waveform is 1:1. Thus, the quantities of mercury moving rightward and leftward are equal and as viewed in a long time, the mercury ions 11 remain at the same position.

When the ratio in time span of the plus side to the minus side of the AC waveform is not equal to 1, movement of mercury occurs. FIG. 7 shows an example of an AC waveform in this case in which the time span of the minus waveform is greater than that of the plus waveform. In this case, assume that the ratio in time span of the plus waveform to the minus waveform is 1:1.5. Then, the quantities of mercury ions 11 moving leftward and rightward are 1:1.5 in ratio. Thus, the mercury ions 11 move rightward as a whole. When this state is repeated for a long time, the mercury within the tube moves toward the right-hand side of the tube, which causes a cataphoresis phenomenon. Thus, it is regarded as important from a standpoint of preventing life degradation that the plus and minus sides of the AC voltage waveform applied across the pair of electrodes of the tube have a ratio of 1:1 in time span or are symmetrical with respect to a zero cross point.

Recently, it is further found that a cataphoresis phenomenon will be caused by movement of mercury within the tube due to a temperature difference along the length of the cathode tube in addition to the reasons mentioned above. When there is a temperature difference along the length of the tube, the mercury moves toward the side of the tube where the temperature is lower and hence the quantity of mercury present on the side of the tube where the temperature is higher gets depleted, which causes the latter side of the tube to be unable to get luminescent.

FIG. 8 shows an example of a case in which there is a temperature difference along and within a cold cathode tube. Assume that there is a heat source 11 outside the tube in the vicinity of its right-hand end in FIG. 8. In this case, heat is transmitted from the heat source 11 to the right-hand end of the tube, thereby increasing its temperature and the mercury within the tube moves leftward. Thus, also in this case, a cataphoresis phenomenon will occur.

FIG. 9 illustrates one example of a result of measurement of a life degradation of the tube due to temperature difference. The vertical axis of this graph represents luminosity with the initial luminosity of the tube represented as 100% and the horizontal axis an elapsed time. As will be seen in this graph, when the temperature difference is small, luminosity degradation hardly occurs, but as the temperature difference increases, the luminosity degradation rapidly occurs. Thus, it will be found that the temperature difference is a factor of degradation of the tube life.

In order to prevent occurrence of a cataphoresis phenomenon due to temperature difference, a conventional method employed is to simply set the heat source at a position spaced from the cold cathode tube or to cool the tube to equalize a longitudinal temperature distribution within the tube. However, with electronic devices such as a small mobile information device that has a limited implementation space, it is difficult to additionally implement a cooling mechanism. In addition to the small electronic devices, electronic devices that include an electronic part such as a CPU which produces a large amount of heat locally are difficult to maintain an even distribution of heat, which also cannot avoid an increase in size.

As described above, with information apparatus on which a display device that includes a cold cathode tube as a light source is mounted, a uniform waveform heat distribution in the circumference of the tube is required from a standpoint of tube life, but a proper space is required in which a cooling mechanism is provided, which is a main cause to hinder the information apparatus from being reduced in size.

It is therefore an object of the present invention to provide an information device that solves the above problems and reduces uneven luminosity and life degradation of a cold cathode tube without hindering a reduction in the size of the tube.

In order to solve the above problems, as shown in FIG. 1 in the present invention, the information apparatus uses a cold cathode tube 2 as a light source for a display device 1, and a DC/AC inverter 4 for driving the tube 2. A pair of temperature sensors 3 detect respective temperatures of both the ends of the tube. A duty cycle of an AC voltage waveform generated by the DC/AC inverter is changed depending on a difference between the sensed temperatures, and the AC waveform is changed so as to move mercury within the tube in a direction reverse to the direction of movement of mercury, depending on the quantity of the mercury moved due to the temperature difference. More particularly, when the right-hand side of the tube is higher in temperature than its left-hand side, mercury moves leftward. Thus, the waveform is changed such that the area of the minus-side AC waveform increases, which can cancel a quantity of mercury moving due to the temperature difference with a quantity of mercury moving due to application of voltage. Thus, the moving quantity of mercury is minimized as a whole, which minimizes a possibility of occurrence of a cataphoresis phenomenon and hence serves to prevent a degradation in the tube life.

The life degradation due to the temperature difference can be understand as an imbalance of a luminance distribution between the right and left sides of the tube. Thus, by detecting the luminances at both ends of the tube with the corresponding detectors 3, calculating a percentage of decrease in the luminance of each tube end from its initial luminance, and when the difference between the luminances is greater than a predetermined value, changing the AC voltage waveform from the DC/AC inverter, the mercury within the tube can be moved toward the end of the tube where the luminance is lower. Thus, the luminance distribution along the length of the tube can be maintained as much uniform as possible, thereby minimizing a reduction in the life of the tube as viewed from the user.

According to the present invention, occurrence of a cataphoresis phenomenon due to temperature difference along the length of the tube is prevented without using any cooling mechanism. Thus, the life degradation of the tube is reduced without impairing the user's convenience due to an increase in the size of the information apparatus whose size reduction is required especially.

Other objects, features and advantages of the invention will become apparent from the following description of the embodiments of the invention taken in conjunction with the accompanying drawings.

DESCRIPTION OF THE EMBODIMENTS

Figure 1:
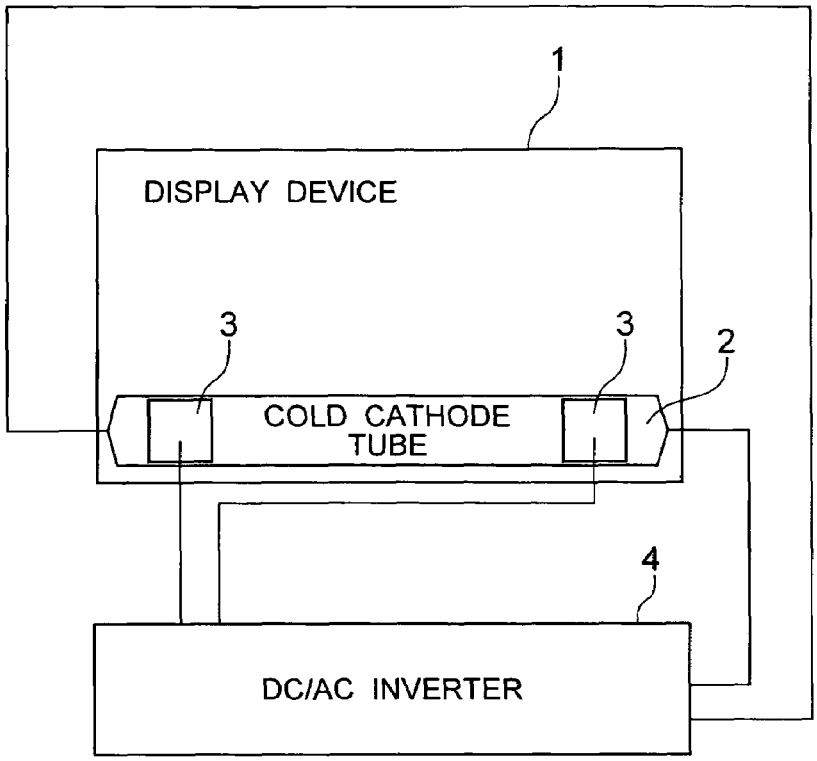
FIG. 1 schematically illustrates the present invention.
Figure 2:
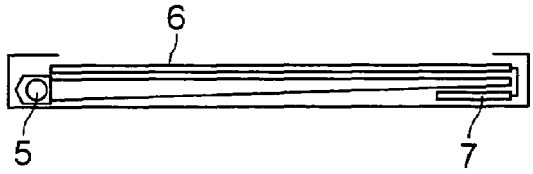
FIG. 2 PRIOR ART
FIG. 2 schematically illustrates the structure of a backlight for a liquid crystal display device.
Figure 3:
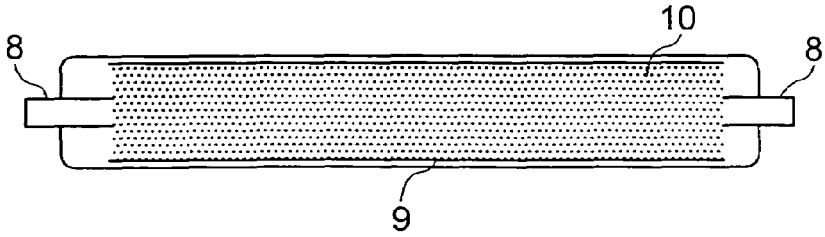
FIG. 3 PRIOR ART
FIG. 3 schematically illustrates the internal structure of a cold cathode tube.
Figure 4:
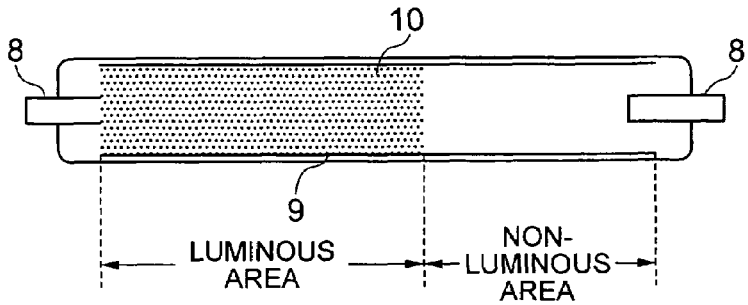
FIG. 4 PRIOR ART
FIG. 4 schematically illustrates a cold cathode tube in which the mercury is within the left-hand half of the tube.
Figure 5:
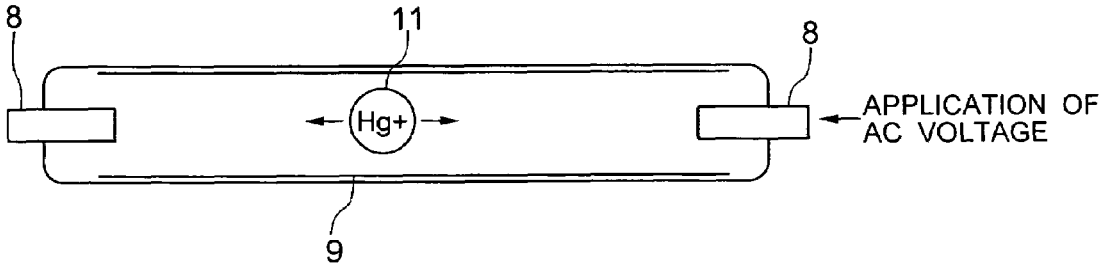
FIG. 5 schematically illustrates the behavior of a mercury ion within the tube.
Figure 6:
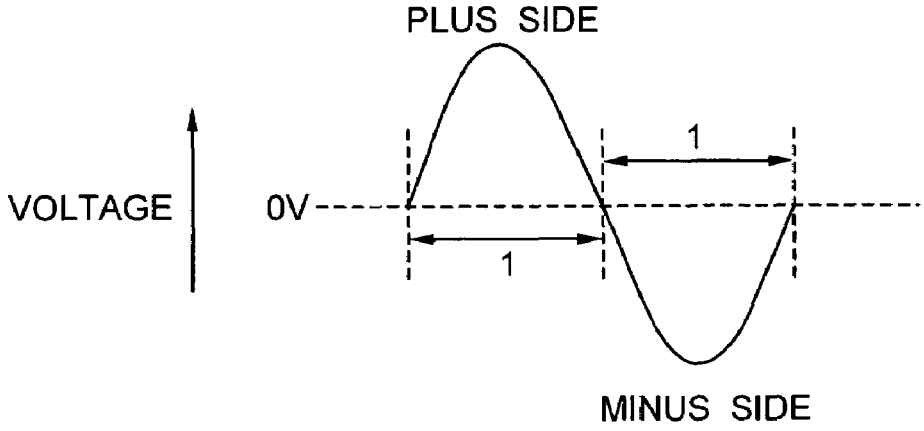
FIG. 6 schematically illustrates a voltage to be applied to a positive electrode 12 in a normal state.
Figure 7:
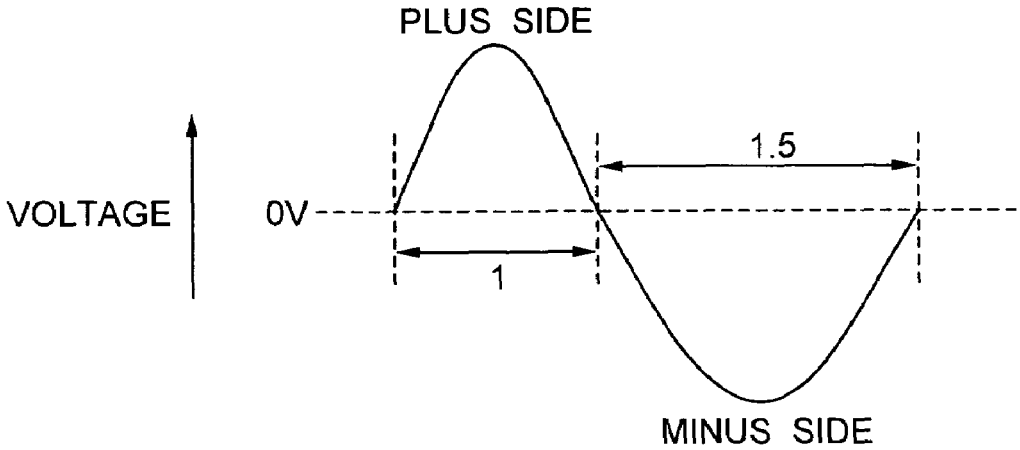
FIG. 7 schematically illustrates a voltage waveform whose plus and minus sides are asymmetrical with a zero cross point.
Figure 8:
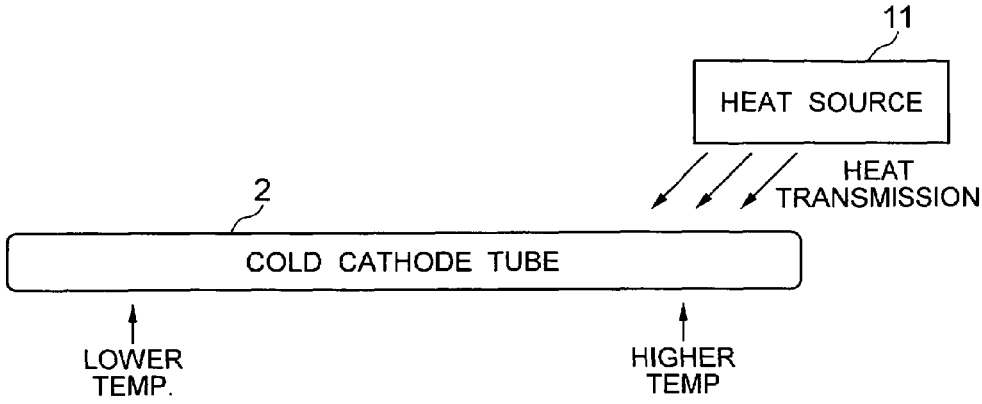
FIG. 8 shown a cold cathode tube with a heat source in the vicinity of one end thereof.
Figure 9:
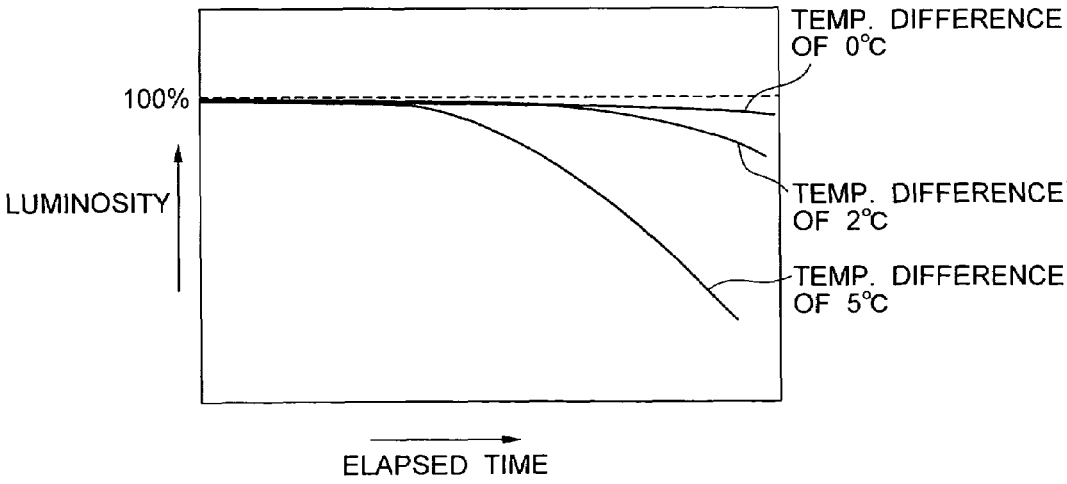
FIG. 9 is a graph indicative of a decrease in the luminance of the tube depending on a temperature difference along the tube.
Figure 10:
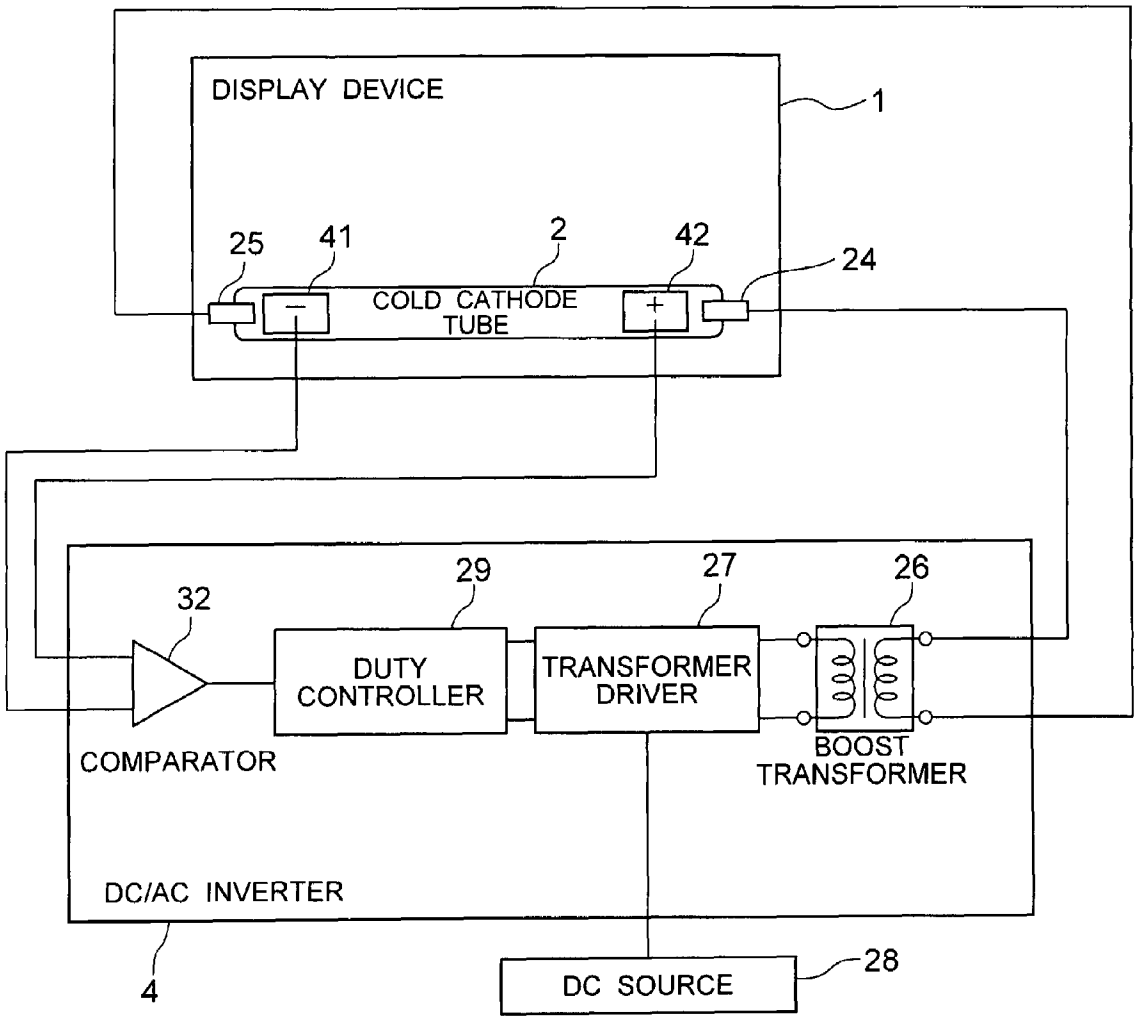
FIG. 10 illustrates the structure of a first embodiment of the present invention.

FIG. 10 shows the first embodiment of an information apparatus according to the present invention, which uses a cold cathode tube as a light source for a display device, and a DC/AC inverter for driving the tube.

In FIG. 10, the display device 1 includes a cold cathode tube 2 as a light source provided therewithin. The tube 2 has a pair of (positive and negative) electrodes 24 and 25 each provided at a respective one of both ends of the tube 2 and are connected to the outputs of the DC/AC inverter 4 to produce an AC voltage waveform. The inverter 4 includes a boost transformer 26 and a transformer driver 27 provided therewithin. The inverter 4 applies a DC voltage received from an external DC source 28 through the transformer driver 27 to the boost transformer 26. An AC voltage produced by the boost transformer 26 is applied to the positive electrode 24 of the tube 2, thereby causing the tube 23 to become luminescent. Positive and negative electrode temperature sensors 40 and 41 are provided in the vicinities of the corresponding positive and negative electrodes, respectively, of the tube 2 and connected to an internal comparator 32 of the DC/AC inverter 4. A difference in temperature between both the ends of the tube 2 compared by the comparator 32 is inputted to a duty controller 29, which determines for the transformer 26 a duty cycle of the waveform to be inputted to the transformer 26 on the basis of the information on the temperature difference.

Figure 12:
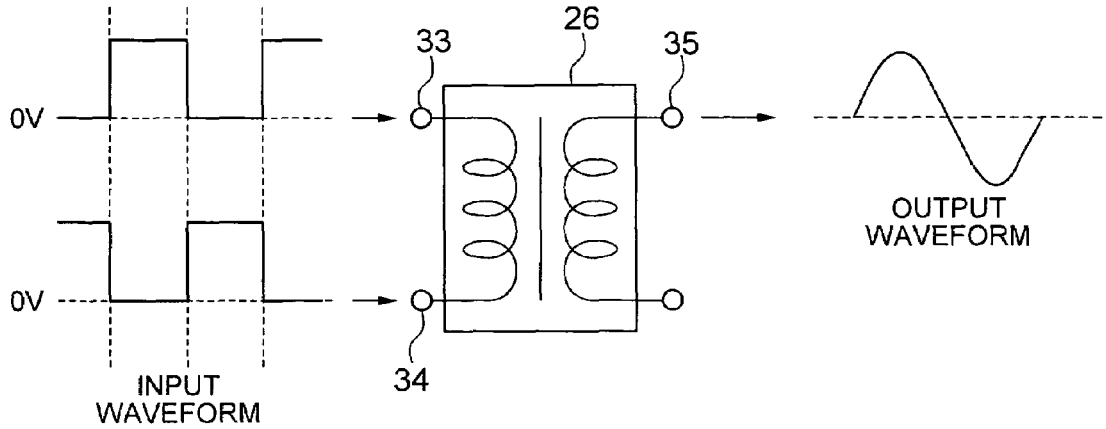
FIG. 12 schematically illustrates input and output voltage waveforms involving a boost transformer 26 where there is no longitudinal temperature difference in the tube.

Operation of the transformer driver 27 will be described next. Voltages of opposite phases shown in FIG. 12 are applied to input terminals 33 and 34, respectively, of a primary side of the boost transformer 26. The phases of the voltages applied to the input terminals 33 and 34 are determined by the duty controller 29. When the duty ratio is usually 1:1, the ratio in on to off time of each of the plus and minus input terminals 33 and 34 also is 1:1. Thus, the ratio in time span of the plus side to the minus side of an AC voltage output from the output terminal 35 also is 1:1. When the duty ratio is changed, the ratio in time span of the plus side to the minus side of the waveform outputted from the output terminal 35 also changes likewise.

Figure 11:
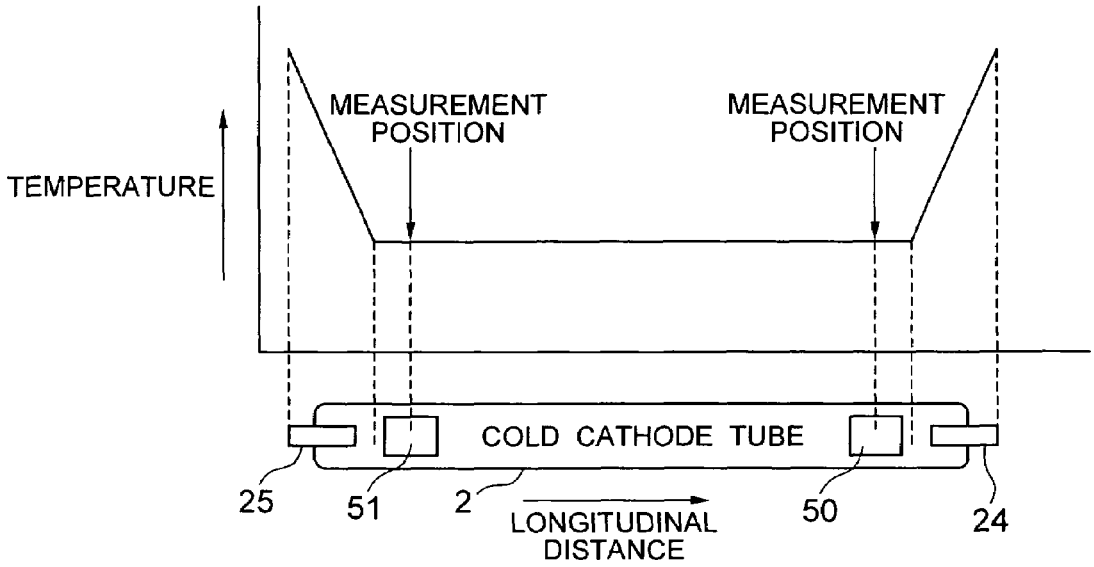
FIG. 11 schematically illustrates a temperature distribution along the tube and positions where the temperature is measured.

Positive and negative electrode temperature sensors 51 and 50 are connected to the cold cathode tube 2. FIG. 11 shows the positions of the temperature sensors 51 and 50 and a temperature distribution along the length of the tube 2 where its temperature is not influenced externally. Since the temperature of the tube 2 usually increases at the electrodes of both ends of the tube 2 due to self heating of the electrodes, the temperature sensors are disposed at positions where they are not influenced by the self heating of the electrodes. Temperature information acquired from these sensors 51 and 50 is inputted to a comparator 32 of the DC/AC inverter 4. The comparator 32 calculates a temperature difference between the positive and negative electrodes 25 and 24 on the basis of the acquired temperature information and then inputs the calculated temperature difference to the transistor driver 27. Based on this information, the transistor driver 27 determines respective on/off times of transformer drive transistors A21 and B22, thereby adjusting an output waveform.

Figure 13:
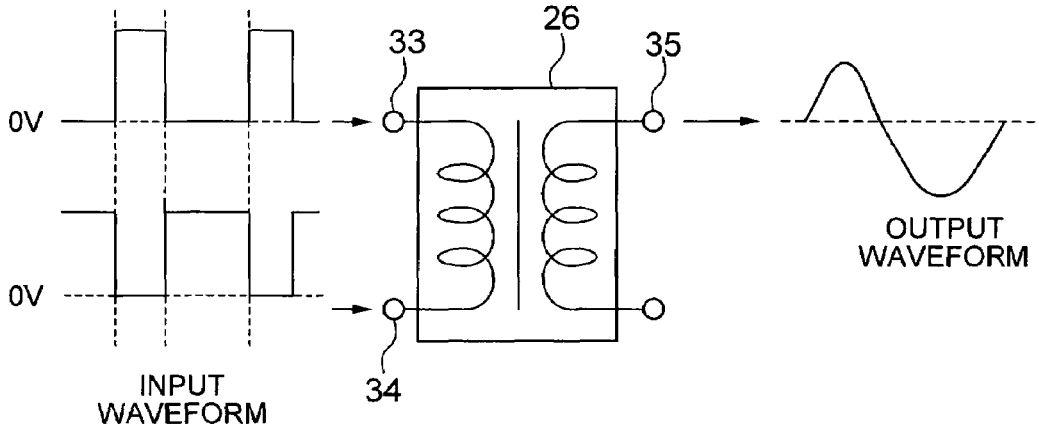
FIG. 13 shown input and output voltage waveforms involving the boost transformer 26 where the right-hand side of the tube is higher in temperature than the left-hand side of the tube.

Operation of the inverter 4 where there is actually a temperature difference will be described next. FIG. 13 shows an example of a voltage to be applied to the boost transformer 26 when the right-hand side of the tube 2 is higher in temperature than its left-hand side. In this case, the mercury ions 11 move leftward within the tube. As shown in FIG. 13, in this case the duty controller 29 reduces an on time of a voltage to be applied to the plus input terminal 33 of the boost transformer 26 and increases an on time of a voltage to be applied to the minus input terminal 34. Thus, the minus side of an AC voltage waveform outputted from the output terminal 35 becomes longer than the plus side of the AC voltage waveform. When the time span of the minus side of the AC waveform to be applied to the positive electrode 24 increases, the mercury ions 11 within the tube 2 move to the right-hand side of the tube and hence leftward movement of the mercury due to the temperature difference is canceled by the rightward movement of the mercury due to the voltage waveform.

Figure 14:
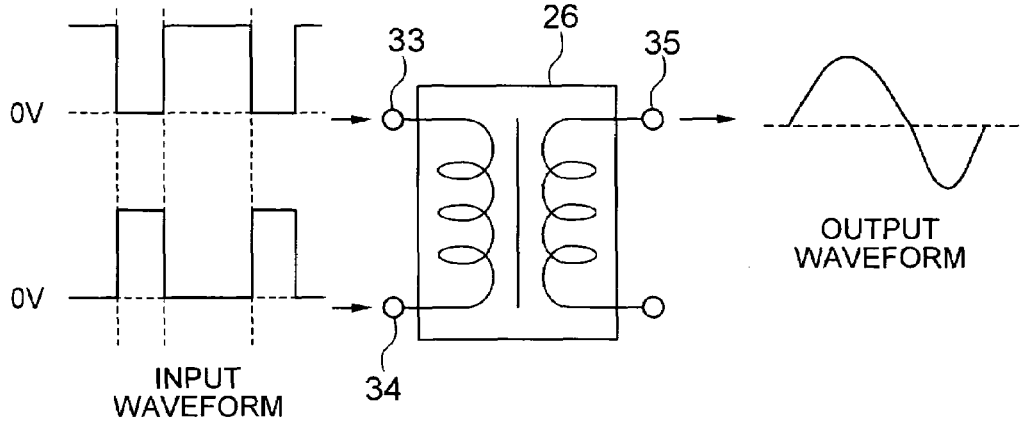
FIG. 14 shown input and output voltage waveform involving the boost transformer 26 where the left-hand side of the tube is higher in temperature than the right-hand side of the tube.

The just-mentioned example relates to the case where the right-hand side of the tube is higher in temperature than its left-hand side. Conversely, when the left-hand side of the tube is higher in temperature than the right-hand side of the tube, operation inverse to that described in the just-mentioned above example occurs. FIG. 14 shows operation of the FIG. 10 embodiment performed when the left-hand side of the tube 2 is higher in temperature than the right-hand side of the tube. At this time, the duty controller 29 controls the transformer driver 27 such that an on time of a voltage to be applied to the plus input terminal 33 of the boost transformer 26 increases and an on time of a voltage to be applied to the minus input terminal 34 decreases. Thus, the plus side of an AC voltage waveform outputted from the output terminal 35 becomes longer. Thus, the mercury ions 11 within the tube 2 move leftward by the voltage waveform, contrary to the case of FIG. 13. That is, rightward movement of the mercury due to the temperature difference is canceled.

Figure 15:
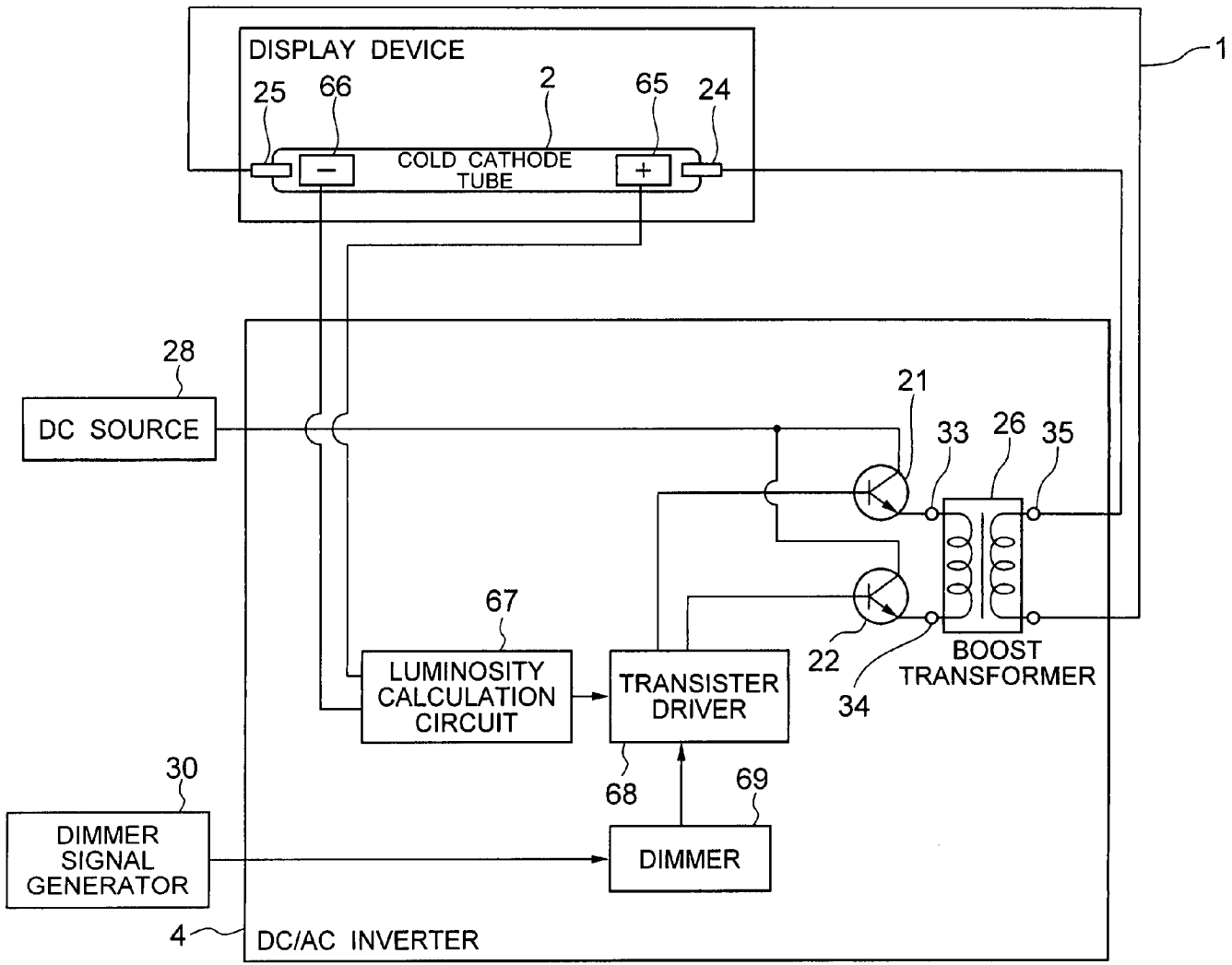
FIG. 15 illustrates the structure of a second embodiment of the present invention.

FIG. 15 illustrates a second embodiment of the information apparatus according to the present invention. The present embodiment uses the same transformer driving system as the first embodiment, but differs from the second embodiment in that the former uses luminosity sensors.

In FIG. 15, positive and negative electrode luminosity sensors 65 and 66 are provided at the positive and negative electrodes 24 and 25, respectively, of the cold cathode tube 2. Values of luminosity detected by these sensors are delivered to a luminosity calculation circuit 67 of the DC/AC inverter 4. The luminosity calculation circuit 67 records initial values of luminosity of both the ends of the tube 2 and then compares decreased values from the respective initial values of luminosity a predetermined time after recording of the initial luminosity values.

In the present embodiment, an output from the DC/AC inverter 4 usually has a waveform of positive and negative halves symmetrical with respect to a zero cross point. When a difference between the decreased values that have decreased from left and right initial luminosity values exceeds a predetermined value, the luminosity calculation circuit 67 adjusts an output waveform from the transistor driver 27 such that mercury moves to the side of the tube where the decrease in luminosity value is greater. That is, when the luminosity calculation circuit 67 determines that a decrease in the luminosity value at the positive electrode from its initial value is greater than that in the luminosity value at the negative electrode, the luminosity calculation circuit 67 gives a command to the transistor driver 27 to move mercury toward the positive electrode and vice versa. Thus, the luminosity calculation circuit 67 operates so as to maintain right and left luminosity distributions uniform, thereby restricting a reduction in the life of the tube. When the difference between the decreased values from their initial luminosity values is below the predetermined set value, the waveform is processed such that its usual symmetrical positive and negative waveform halves are restored.

Figure 16:
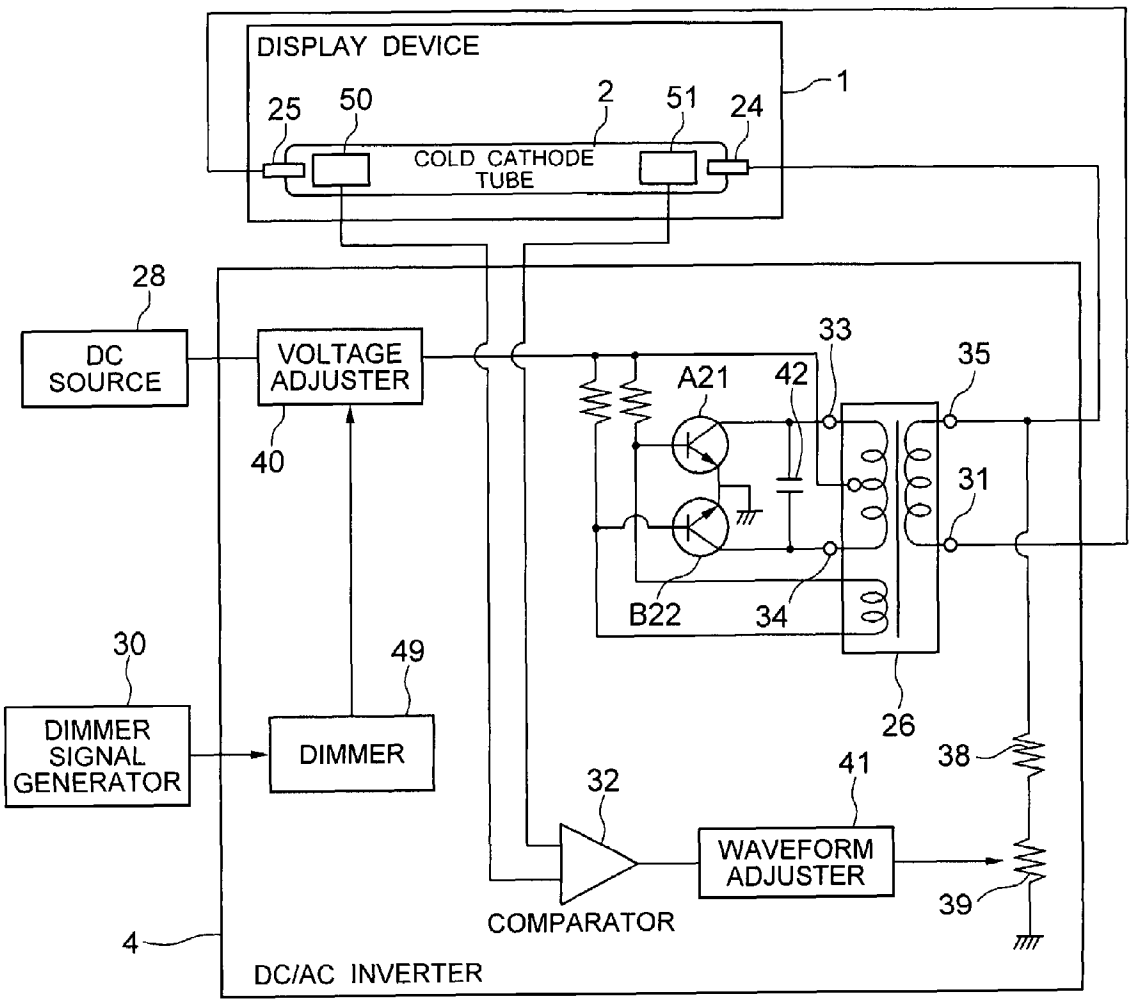
FIG. 16 illustrates the structure of a third embodiment of the present invention.

FIG. 16 illustrates a third embodiment of the information apparatus according to the present invention. In this embodiment, a cold cathode tube 2 is used as a light source of a display device. Further, a DC/AC inverter 4 is used in which and a Royer's self-excited type driver is used to drive the transformer, and a voltage dimmer system is used to adjust the luminosity of the tube.

The third embodiment is different from the first embodiment in that in the self-excited circuit used in the third embodiment, resonance occurring due to a combination of an inductor component of the boost transformer 26 and a capacitive component of a resonant capacitor 42 automatically turns on/off transistors A21 and B22 for driving the transformer. Thus, the third embodiment does not use an element such as the transistor driver 27 used in the first embodiment, and cannot control an on/off time of each of the plus and minus input terminals 33 and 34 of the boost transformer 26. Thus, in the present embodiment a high voltage resistant resistor 38 and a variable resistor 39 are connected in series between the output terminal 35 of the boost transformer 26 and ground such that the waveform adjuster 41 changes a resistance value of the variable resistor 39 on the basis of temperature difference information produced by the comparator 29, thereby changing the output waveform directly. Like the output waveform where there is no temperature difference, the plus and minus sides of the output waveform are 1:1 in time span. Assume that the variable resister 39 is set to a value R larger than zero.

Figure 17:
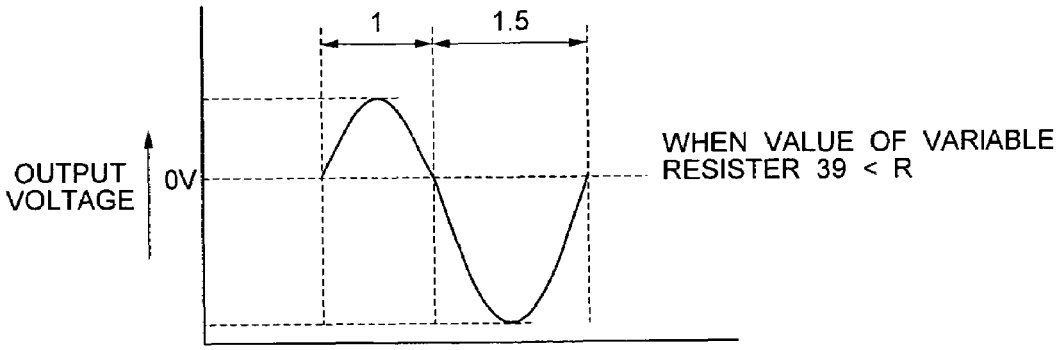
FIG. 17 shows an output voltage waveform where the right-hand side of the tube is higher in temperature than the left-hand side of the tube in the third embodiment.

Operation of the third embodiment when there is an actual longitudinal temperature difference within the tube 2 will be described. FIG. 17 illustrates a voltage waveform to be applied to the positive electrode 24 of the cold cathode tube 2 when the right-hand side of the tube 2 is higher in temperature than the left-hand side of the tube 2. In this case, the mercury ions 11 within the tube 2 move leftward. The waveform adjuster 41 adjusts the variable resister 39 so as to be lower than its initial value R, which causes the whole waveform to move toward the minus side. Thus, as shown in FIG. 17, the plus and minus sides of the output waveform become shorter and longer, respectively, in time span. Assume in FIG. 17 that the time span of the plus side of the waveform to be applied to the plus electrode 24 is 1. Then, the time span of the minus side of the waveform to be applied to the left electrode 25 is 1.5. When the time span of the minus side of the AC waveform to be applied to the positive electrode 24 increases, the mercury ions 11 within the tube 2 move rightward. Thus, the leftward movement of mercury due to the temperature difference is canceled by the rightward movement of the mercury ions due to the voltage waveform.

Figure 18:
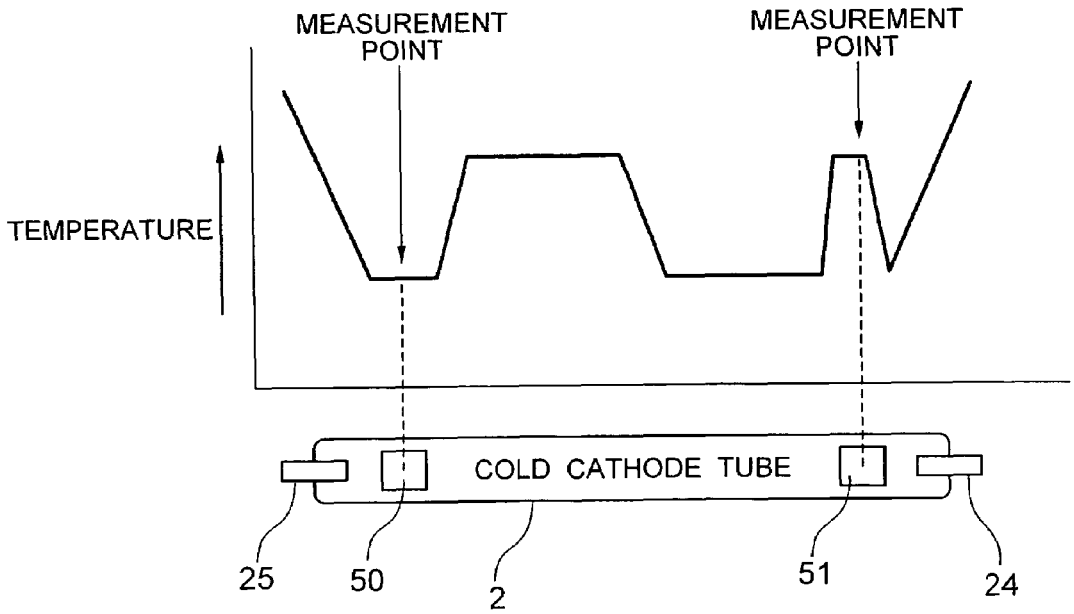
FIG. 18 schematically illustrates a non-linear temperature distribution along the tube.

In the first and third embodiments, the temperature of the tube 2 is detected at the two positions on the positive and negative electrode sides of the tube. This is effective when a difference in temperature between the positive and negative electrode sides is linear along the length of the tube, but when it is nonlinear, a change in the waveform becomes ineffective and in some cases, gives adverse effect. FIG. 18 illustrates a non-linear temperature distribution along the length of the tube 2. In this case, it is determined that the temperature sensed by the positive electrode temperature sensor 51 is higher than that sensed by the negative electrode temperature sensor 50 and that the mercury ions 11 o move toward the negative electrode side. Thus, the output waveform is adjusted such that its minus side becomes longer to move the mercury ions 11 toward the positive electrode side. However, since the half of the tube between its midpoint and the positive electrode has more lower-temperature portions than that of the tube between its midpoint and the negative electrode, the mercury ions 11 are apt to move toward the positive electrode side. Thus, when the number of temperature measurement positions is only two, a cataphoresis phenomenon can occur and grow rapidly, conversely.

Figure 19:
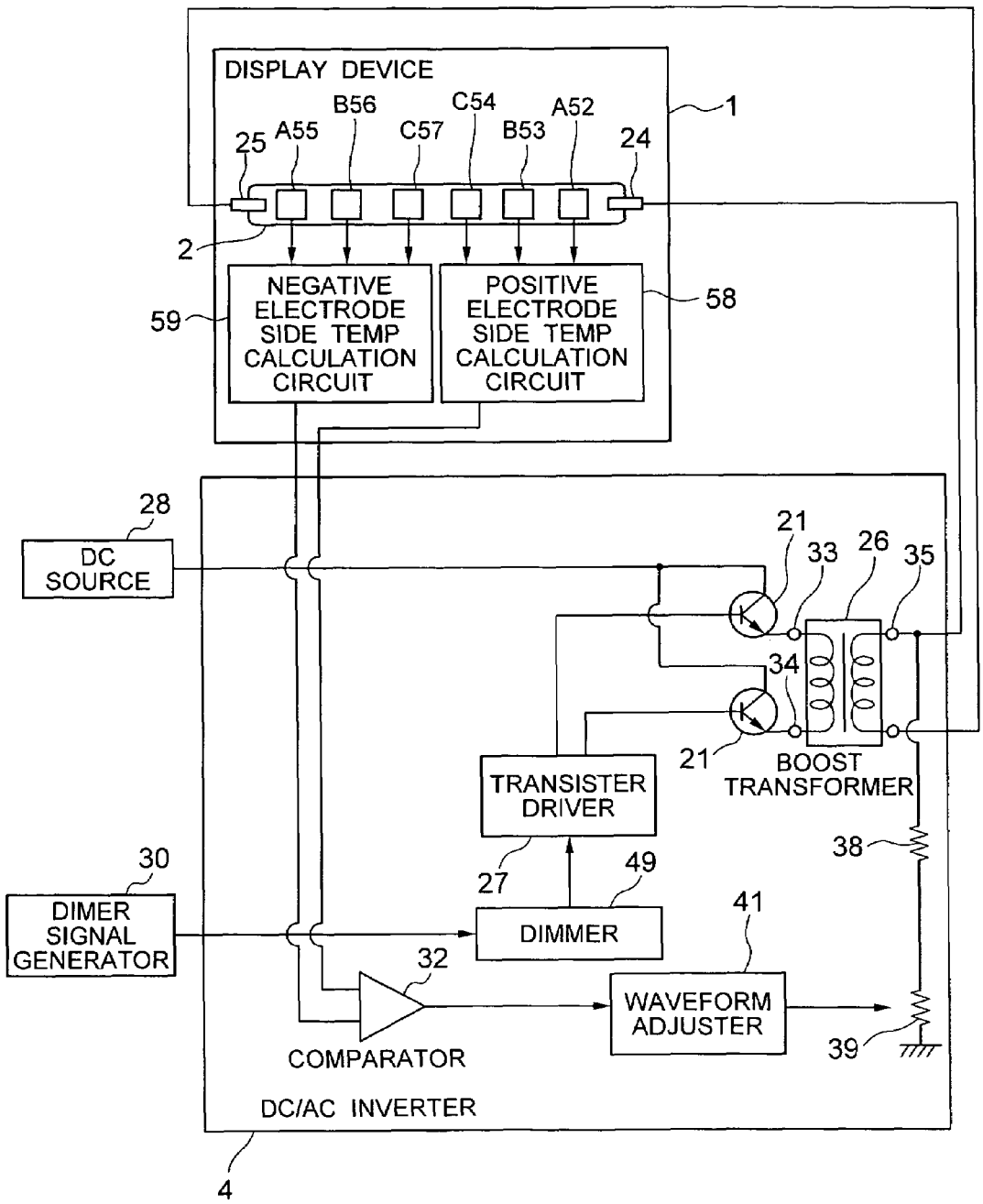
FIG. 19 illustrates the structure of a fourth embodiment of the present invention.

A method of solving this problem has been thought out in which with more than two measurement points, average temperature of each of the positive and negative electrodes sides from a midpoint of a longitudinal direction of the tube are calculated, thereby adjusting the output waveform. FIG. 19 shows a fourth embodiment using a plurality of temperature measurement points. On the basis of the third embodiment, three positive electrode side temperature sensors A52, B53 and C54 are arranged in the positive electrode side from the midpoint of the tube 2 while three negative electrode side temperature sensors A55, B56 and C57 are arranged in the negative electrode side from the midpoint of the tube 2, i.e. six temperature measurement positions in all are provided.

The temperatures sensed by the three positive electrode side temperature sensors are inputted to a positive electrode temperature calculation circuit 58 while the temperatures sensed by the three temperature sensors negative electrode side temperatures are inputted to a negative electrode temperature calculation circuit 59. Each of the calculation circuits 58 and 59 calculates an average value of the inputted three temperatures and then inputs the corresponding calculated average value to a comparator 32. This allows to take account of a temperature distribution more precisely than when only the two temperature measurement positions are set, thereby correcting the waveform more appropriately.

While in the present embodiment the number of measurement points is illustrated as six, another number of measurement points may be set to produce similar advantageous effects, of course. While the temperature calculation circuits usually calculate an average value of temperatures at a plurality of points, the respective measured temperature values may be weighted on the basis of the measurement positions or a mercury distribution characteristic present along the length of the tube. While in the present embodiment the temperature calculation circuits are illustrated as provided on the side of the display device 1, it may be provided on the side of the DC/AC inverter 4 to produce similar advantageous effects. While in the present embodiment the detectors are illustrated as comprising temperature sensors, it is obvious that a plurality of luminosity sensors and weight sensors may be provided in the second and third embodiments, respectively, to produce similar advantageous effects.

Figure 20:
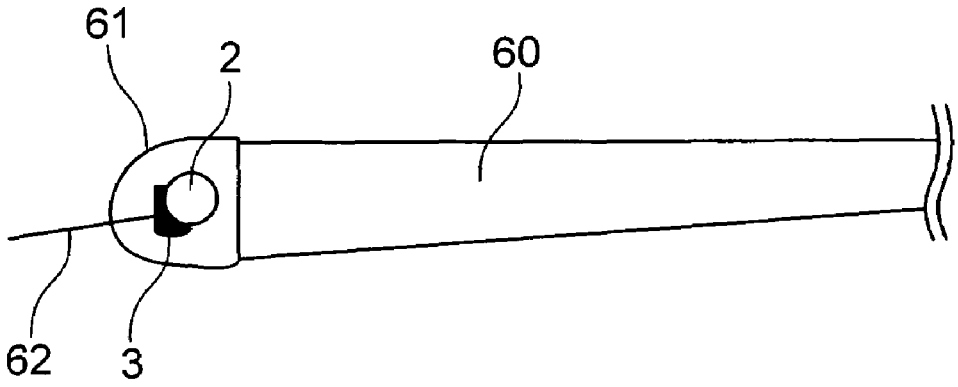
FIG. 20 is a cross-sectional view of the vicinity of a cold cathode tube where a temperature sensor is directly connected to the tube.

There is a problem with the method of implementing the temperature sensors that needs to be considered. FIG. 20 is a cross sectional view of the vicinity of a backlight or cold cathode tube 2 of the display device. Light produced by the cold cathode tube 2 is reflected by a reflector 61 and collected on an end of a light conductor 60 which functions to diffuse the collected light uniformly onto the front of the display device at the other end of the light conductor 60.

Figure 21:
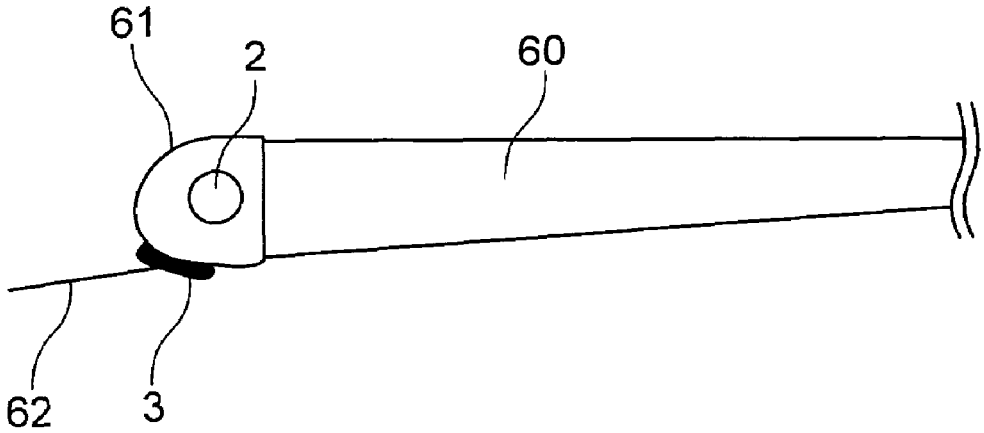
FIG. 21 is a cross-sectional view of the vicinity of a cold cathode tube where a temperature sensor is directly connected on an outer surface of a reflector.

In order to measure accurate temperatures of the tube, as shown in FIG. 20 the temperature sensor 3 should preferably be provided in direct contact with a front of the tube 2. According to this method, however, light at the position where the temperature sensor 3 is set is physically blocked by a quantity corresponding to the area of the sensor 3 and there can occur an uneven luminosity when the whole display device is viewed. Use of a transparent material for the detector will reduce occurrence of uneven luminosity. However, wiring 62 to obtain temperature information from the temperature sensor 3 also is required, which would influence the luminosity to some extent. Thus, it is difficult to eliminate these influences completely In order to solve this problem, the temperature sensor 3 is required to be provided on the outer surface of the reflector 61 in the vicinity of the measurement position, as shown in FIG. 21. According to this structure, no uneven luminosity occurs because the temperature sensor 3 and wiring 62 that would otherwise hinder light produced by the tube 2, thereby causing uneven luminosity, are provided outside the reflector 61. In this case, the accuracy of the temperature measurement is lowered to some extent. However, since a main factor by which the temperature distribution of the tube changes is heat conducted externally. In addition, since the reflector and tube are usually disposed close to each other, the temperature measurement is directly proportional to the temperature distribution of the tube even when the temperature sensor is set on the outer surface of the reflector. Thus, the waveform adjustment based on the temperature difference is effective to prevent a degradation in the tube life.

While in the present embodiment the boost transformer is illustrated as driven by the externally commutated DC/AC inverter, it is obvious that the boost transformer may be driven by a self-commutated DC/AC inverter to produce similar advantageous effects according to the present invention. While in the present embodiment the comparator is illustrated as directly comparing the outputs of the temperature sensors in the temperature detecting method, of course, these outputs may be digitized by an A/D converter before comparison. While the boost transformer 26 is illustrated as a wound transformer, it may comprise a piezoelectric element instead.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device comprising:

a cold cathode tube as a light source for the display device;

at least two temperature sensors for sensing temperatures at corresponding positions along the length of the tube;

a comparator for obtaining a difference between the temperatures sensed by the temperature sensor;

an AC signal output unit for changing a duty cycle of the AC signal to be applied to the tube depending on result obtained by the comparator; and a calculation circuit for calculating an average value of temperatures sensed by each of the plurality of sensors of both sides of the midpoint of the tube, wherein a plurality of temperature sensors are provided in each of both sides of a midpoint of the tube, wherein the comparator obtains a difference of sensed temperatures on the basis of the average values of temperatures calculated by the calculation circuits.

2. The display device of claim 1, wherein:

the at least two temperature sensors are provided on both sides of a midpoint of the tube.

3. The display device of claim 1, wherein:

the at least two temperature sensors are provided at both ends of the tube spaced from electrodes of the tube.

4. The display device of claim 1, further comprising a reflector for reflecting light emitted by the tube; and wherein:

the at least two temperature sensors are set at the reflector.

* * * * *